United States Patent [19]

Koide et al.

[11] Patent Number: 4,934,552

[45] Date of Patent: Jun. 19, 1990

[54] SEALED VESSEL AND A PROCESS FOR PRODUCING THE SAME

[75] Inventors: Shigeyuki Koide; Osamu Usami, both of Minamiashigara; Tunehisa Sekiguchi; Norihito Kohama, both of Tokyo, all of Japan

[73] Assignee: Showa Denko Kabushiki Kaisha, Tokyo, Japan

[21] Appl. No.: 262,329

[22] Filed: Oct. 25, 1988

[30] Foreign Application Priority Data

Apr. 8, 1988 [JP] Japan ..... 63-86640

[51] Int. Cl.[5] ..... B65D 39/00

[52] U.S. Cl. ..... 220/310; 53/489; 62/509; 220/358

[58] Field of Search ..... 53/324, 328, 329, 343, 53/344, 488, 489; 62/244, 503, 507, 509; 220/67, 352, 358, 309, 310

[56] References Cited

U.S. PATENT DOCUMENTS

| | | | |
|---|---|---|---|
| 35,529 | 6/1862 | Lyman | 220/358 |
| 323,153 | 7/1885 | Ives | 220/358 |
| 788,122 | 4/1905 | Townsend | 220/352 |
| 1,450,422 | 4/1923 | Leighton | 220/352 |
| 1,747,591 | 2/1930 | Moore | 220/358 |
| 3,339,605 | 9/1967 | Ignell | 220/352 |
| 3,581,456 | 6/1971 | Gere | 53/488 |
| 3,613,935 | 10/1971 | Rogge | 220/352 |
| 4,016,096 | 4/1977 | Meyer | 220/358 |
| 4,738,376 | 4/1988 | Markus | 220/352 |

FOREIGN PATENT DOCUMENTS

| | | | |
|---|---|---|---|
| 0659524 | 10/1951 | United Kingdom | 220/358 |

*Primary Examiner*—Jimmy G. Foster

*Attorney, Agent, or Firm*—Spensley Horn Jubas & Lubitz

[57] ABSTRACT

A sealed vessel including a cylindrical body portion having an open end, and a cover fitting in the open end of the body portion, said sealed vessel being produced by pressing the open end of the body portion from the outside of the body portion to an outer peripheral surface of the cover provided with at least one of annular grooves around the outer peripheral surface of the cover to air-tightly fix the open end of the body portion and a process for producing the same are disclosed. According to the present invention, it is not necessary to perform any work such as a groove formation on a surface of the body portion but only necessary to provide one or more grooves on the outer peripheral surface of the cover. And in the case of using an electromagnetic force as the means for press-working, a part of the body portion is strictly and air-tightly fixed to the annular grooves at a moment and thus the sealed vessel can be produced with ease and at low costs.

32 Claims, 3 Drawing Sheets

SEALED VESSEL AND A PROCESS FOR PRODUCING THE SAME

BACKGROUND OF THE INVENTION

The present invention relates to a readily producible pressure resistant sealed vessel, for example, a sealed vessel used as a liquid tank integrated into a cooling medium circular system of an air-conditioning equipment of an automobile or the like, and a process for producing the same.

Conventionally, a sealed vessel such as a gas bomb, a drinking can or the like has been produced by manufacturing a body portion and a cover portion thereof separately and connecting or coupling the cover to the body portion by means of welding or mechanical fitting, or integrally fabricating both the body portion and the cover. For example, a liquid tank integrated into an air-conditioning equipment of an automobile or the like has functions of controlling an amount of cooling medium circulating in a cooling circular system and filtering the cooling medium by removing moisture or other contaminants such as dusts and wastes and supplying the cleaned cooling medium to a expansion valve, and usually stores high-pressure cooling medium therein. For these reasons, a sealed vessel made of steel which is produced by welding a cover 4 having an inlet pipe 4*a* and an outlet pipe 4*b* for the cooling medium to an opening portion of a bottomed cylindrical body portion 1 or an opening portion of a cylindrical body portion 2, another opening portion of which is welded to a cover 3 to form a bottom portion thereof as shown in FIGS. 1 and 2, have been conventionally used. However, it requires much labor to produce the sealed vessels by means of welding as mentioned above, and particularly in the case of using aluminum or aluminum alloy as a material for lightening the sealed vessel completed, the welding procedure itself accompanies difficulties as well as high expenses.

Thus, so as to simplify the process for producing a sealed vessel and reduce its costs for production, a liquid tank is developed which is provided with irregular portions 5 and 5 both on an inner peripheral surface of an opening end of a bottomed cylindrical body portion 1 and on an outer peripheral surface of a cover 4, the cover 4 having an inlet pipe 4*a* and an outlet pipe 4*b* for cooling medium so that the recess portions of the outer peripheral surface of the cover 4 engages the convex portions of the inner peripheral surface of the body portion 1 and the convex portion of the inner peripheral surface of the body portion 1 engages the recess portion of the outer peripheral surface of the cover 4 and annular recess grooves 6 and 6 both on the midway of the irregular portions 5, the recess grooves 6 being opposed to each other with maintaining the engagement of the irregular portions 5 and intervening an 0-ring between the annular recess grooves 6 and 6, and the cover 4 being air-tightly fixed to the body portion 1 by uniformly pressing the irregular portion 5 of the bottomed cylindrical body portion 1 to the irregular portion 5 of the cover 4 by means of roller or the like to pressure-weld the inner peripheral surface of the opening end of the body portion 1 to the outer peripheral surface of the cover 4 as shown in FIGS. 3 and 4 (Japanese Utility Model Laid Open No. 62-52858). In the tank, desiccating agent 8, glass wool 9 and mesh 10 are laminated and they are pressed by a press device 11. The cooling medium introduced from an inlet pipe 4*b* is brought into contact with the desiccating agent 8 and subsequently drawn out through the outlet pipe 4*a*, whereby moisture and contaminants such as dusts and wastes contained in the cooling medium are removed. In the drawings, reference numeral 12 designates a side glass for observing the inside of the tank and reference numeral 13 designates an 0-ring. Since the liquid tank above-described is fabricated not by welding procedure but by pressure welding its body portion and its cover, it is possible to widely use various materials such as steel, aluminum, aluminum alloy or the like. However, irregular portions 5 must be provided on the inner peripheral surface of the open end of the body portion 1 having a relatively thin thickness and the outer peripheral surface of the cover 4 so that the recess portion of the irregular portion 5 of the body portion 1 engages the convex portion of the cover 4 and the convex portion of the irregular portion 5 of the body portion 1 engages the recess portion of the cover, respectively and the annular grooves 6 and 6. In addition, the relative positioning or embedding relationship of the respective recess and convex portions of the inner peripheral surface of the open end of the body portion 1 with the respective convex and recess portions of the cover 4 must be maintained without any deviation therebetween upon fixing the cover 4 to the body portion 1.

SUMMARY OF THE INVENTION

As a result of earnest investigations so as to overcome the above mentioned defects, the present inventors have found that it is possible to air-tightly and strictly fix a cover of a sealed vessel to a body portion thereof only by a processing of an outer peripheral surface of the cover without performing a processing of an inner peripheral surface of the body portion, the body portion having relatively thin thickness and it is suitable to adopt a plastic deformation using the known electromagnetic force as a method for pressing the body portion to the outer peripheral surface of the cover from the outer peripheral surface side of the body portion.

The present invention has been accomplished based on these findings.

An object of the present invention is to provide a sealed vessel which can be produced with ease and at low costs.

Another object of the present invention is to provide a process for producing the sealed vessel by which the body portion of the sealed vessel is strictly fixed to the cover even if the relative position of the body portion to the cover is slightly deviated.

According to the present invention, the above objects are achieved by pressing an inner peripheral surface of a cylindrical body portion to an outer peripheral surface of a cover which has at least one annular groove, said groove being provided around the outer peripheral surface, from the outer peripheral surface side of the body portion and strictly connecting or coupling the body portion to the cover. At this time, it is desired to place or embed a sealing member such as an 0-ring in the annular groove in the case of the sealing vessel requiring high degrees of pressure resistance and sealing such as a liquid tank. In this case, it is preferred that a plurality of annular grooves is provided around the outer peripheral surface of the cover besides the annular groove intervened with the sealing member, at least one of which is worked to a broad belt-like structure because the pressed body portion is bent and bites into the broad belt-like annular groove while the inner peripheral surface of the body portion is pressure-welded to the outer peripheral surface of the cover to strictly seal the vessel upon plastic deformation of the body portion. Furthermore, it is preferred that the body portion may be plasticly deformed by means of the known electromagnetic force. Since the electromagnetic deformation enables uniform and strict pressing at a moment, the connection or coupling of the body portion to the cover of the vessel becomes strict and tight and the weak and brittle portion such as "thermally affected portion" caused by the melting of the metal, for example, occurred in the MIG welding is not occurred.

According to the present invention, it is not necessary to perform any work such as a groove formation on a surface of a body portion of thin thickness but only necessary to provide one or more grooves on an outer peripheral surface of the cover. Thus working procedures for producing the sealed vessel is rendered more easy and the restriction for positioning the cover with respect to the body portion at the time of fixing the cover to the body portion is more relaxed. In addition, the cover is air-tightly and strictly fixed to the body portion by the force from the outer peripheral surface of the body portion and then the inner peripheral surface of the body portion is tightly brought into contact with the outer peripheral surface of the cover in cooperation with the packing effect of the sealing member embedded in the annular groove. Furthermore, in the case of providing a broad belt-like annular groove around the outer peripheral surface of the cover and rendering a part of body portion bent and bit into the belt-like groove, the inner surface of the body portion is strictly brought into contact with the edge of the groove and, with a result, the degree of the sealing is greatly increased. The cross-section of the broad belt-like annular groove is preferred to be rectangular shape. In the case where the body portion is bent and bit into the broad belt-like annular groove, the force acting on a corner portion S is proportional to $l^3$ since it acts uniformly on span 1, as shown in FIG. 12. And furthermore, the strict pressing of the body portion to the outer peripheral surface of the cover is done at a moment by using an electromagnetic force as a means therefor, which enables the engagement of the bent body portion with the broad annular groove and thus enables the effective and expensive production of a sealed vessel. If the electromagnetic force is used for press-working, a predetermined amount of electric current is flown into an induction coil to cause Lorentz force in accordance with the "Left Hand Rule of Fleming's" and this force acts on the body portion to complete the press-working at a moment. The rate of the deformation at this time is approximately as high as 300 m/s.

DETAILED DESCRIPTION OF THE INVENTION

The present invention will be now described in detail with reference to the accompanying drawings but the present invention should not be restricted to the following embodiments.

Figure 1:
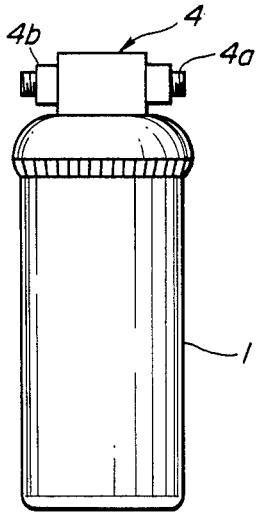
FIG. 1 is a side view of a conventional liquid tank.
Figure 2:
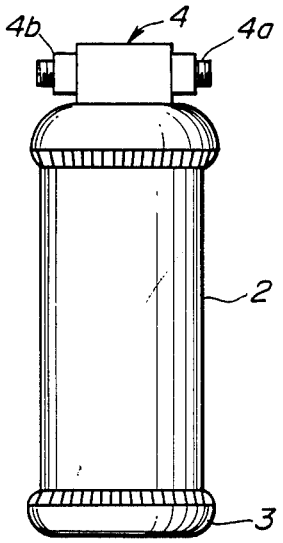
FIG. 2 is a side view of another conventional liquid tank.
Figure 3:
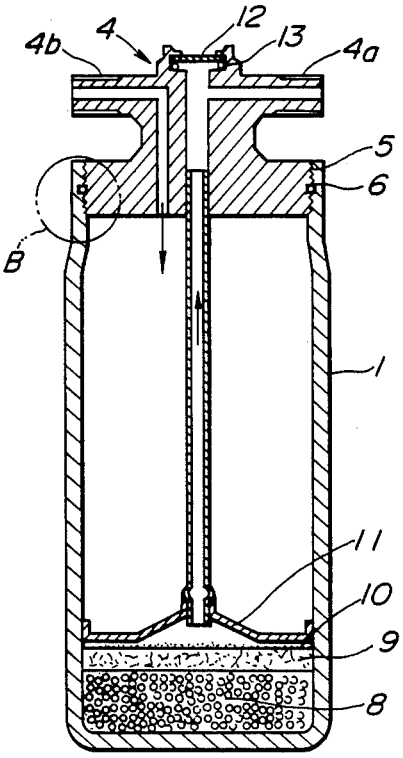
FIG. 3 is a longitudinal sectional view of another example of a conventional liquid tank.
Figure 4:
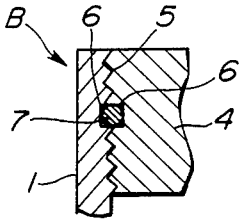
FIG. 4 is a enlarged view of the B portion of FIG. 3.
Figure 5:
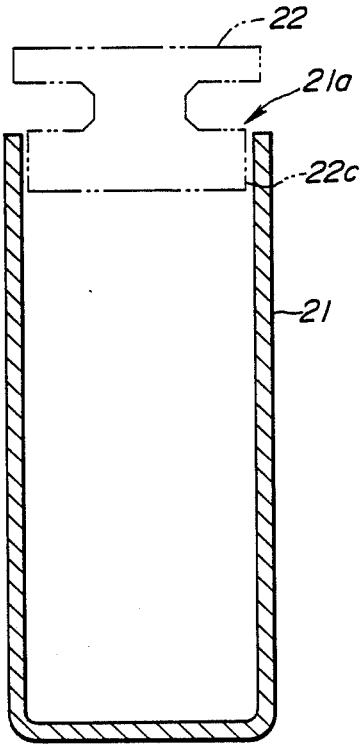
FIG. 5 is a longitudinal sectional view of a body portion of a sealed vessel according to an embodiment of the present invention.

FIGS. 5 to 9 illustrates a sealed vessel according to an embodiment of the present invention. FIG. 1 is a longitudinal sectional view of an forged bottomed cylindrical body portion 21. The body portion 21 is made of a metal. Such a metal includes, for example, steel, aluminum and aluminum alloy. However, any metals being capable of plastic deformation and having a sufficient strength may be used in the present invention.

Figure 6:
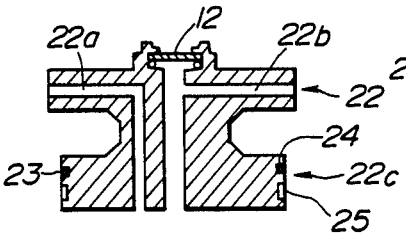
FIG. 6 is a longitudinal sectional view of a cover of a sealed vessel according to an embodiment of the present invention.
Figure 7:
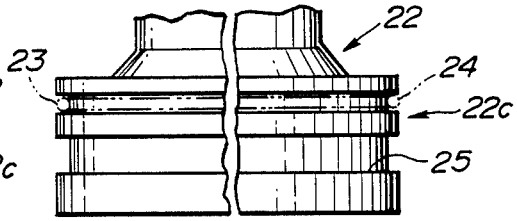
FIG. 7 is a partial side view of the cover portion shown in FIG. 6.

FIGS. 6 and 7 are a longitudinal sectional view and a partial side view of a cover 22, respectively. The cover 22 has an inlet pipe **22*a* and an outlet pipe 22*b* for fluid, and a cylindrical outer peripheral surface 22*c* so as to fit the outer peripheral surface 22*c* thereof to an inner peripheral surface of the body portion 21. Around the cylindrical outer peripheral surface 22*c*, a narrow annular groove 24 for intervening a sealing member 23 and a broad belt-like annular groove 25 are provided and the diameter formed by the outer peripheral surface 22*c* is worked to be slightly shorter than the inside diameter of the body portion 21**.

The cover 22 is usually made of the same material as that of body portion. However, the cover 22 can be made of the material different from that of the body portion and the cover 22 may be made of non-deformable plastics such as phenol resin, epoxy resin, polycarbonate or the fiber reinforced resins thereof.

As the sealing member so as to seal the sealed vessel, an 0-ring made of rubber and/or plastics is generally used. However, particularly in the case where both the cover and body portions are made of metallic materials, ceroplastic material such as powders of soft solder, lead, tin etc., mixture of ceroplastic materials and plastic binders, or combined mixture of rubber and/or plastics and ceroplastic material may be used therefor.

Figure 8:
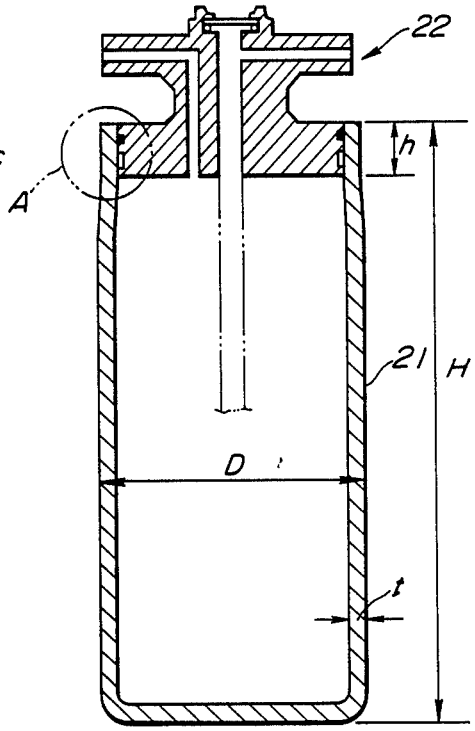
FIG. 8 is a longitudinal sectional view of a sealed vessel according to an embodiment of the present invention.

The sealed vessel as shown in FIG. 8 is produced by supporting the cylindrical outer peripheral surface **22*c* of the cover 22 to the inner peripheral surface of an open end 21*a* of the body portion 21 oppositely, pressing the supported body portion 21 and cover 22 from the outer peripheral surface side of the body portion 21 and plastic-deforming the open end 22*c* of the body portion 21 to strictly connect or couple the inner peripheral surface of the body portion 1 to the outer peripheral surface 22*c* of the cover 22. Desiccating agent, glass wool, mesh and the like are placed or laminated and a conduit having a stopper is connected to an outlet pipe 22 of the cover 22 prior to fixing the cover 22 to the body portion 21, if necessary. By the press-working, the outer peripheral surface of the cover 22 must be strictly brought into contact with the inner surface of the body portion 21 by the press-working in the manner above-described. However, it is very difficult to bend the body portion 21 and engage the bent body portion with the belt-like annular grooves shown in FIG. 9 by generally performed mechanical press-working. Thus, it is preferred that the known plastic deformation method using the electromagnetic force is applied. If so, the body portion 21 can be engaged with the belt-like groove 25 with ease and in a short time. When using the electromagnetic force, the press-working time required therefor is approximately 0.9 msec and the rate of deformation is approximately 320 m/sec. And when using the electromagnetic force, the follow up characteristic of the deformation is excellent and the deformation is uniformly and strongly done with a small residual unit stress and no occurrence of defects such as wrinkles or the like since the body portion 21 is plastic deformed at a rapid speed. Incidentally, in FIG. 9, the inner peripheral surface of the body portion 21 is drawn not in contact with the bottom of the broad belt-like annular groove 25 of the cover. However, the inner peripheral surface of the body portion may be brought into contact with the bottom of the groove 25** depending on the conditions of press-working.

Figure 10:
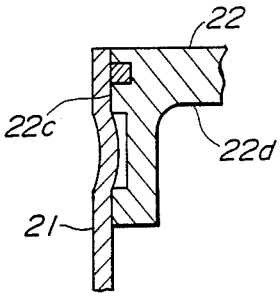
FIG. 10 is an enlarged view showing an annular groove corresponding to the A portion of FIG. 9.

The cover may be varied in its shape as if the midway portion thereof is made slightly thin in its thickness while having an outer peripheral surface 22c with a predetermined width as shown in FIG. 10.

Figure 12:
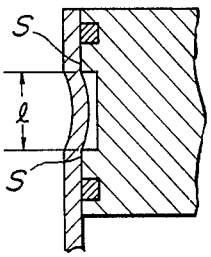
FIG. 12 is an enlarged view showing yet another annular groove corresponding to the A portion of FIG. 11.
Figure 11:
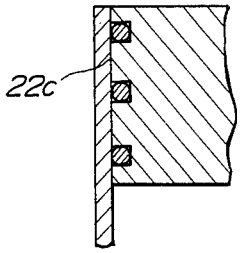
FIG. 11 is an enlarged view showing another annular groove corresponding to the A portion of FIG. 9.

FIGS. 11 and 12 illustrate, respectively, other embodiments of an annular groove formed around the outer peripheral surface of the cover. FIG. 11 is an embodiment showing the one having no broad belt-like annular groove. Such a cover is used in the case of the cover being made of plastics. FIG. 12 is an embodiment having two annular groove intervened with sealing members. Besides, various combinations of the shape or configuration of the cover can be adopted depending on the height of the outer peripheral surface of the cover.

Figure 13:
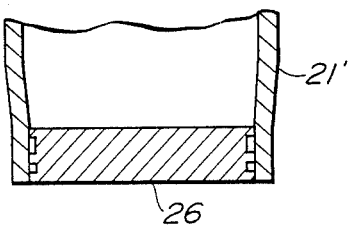
FIG. 13 is a longitudinal sectional view showing a bottom portion of a vessel according to another embodiment of the present invention.

FIG. 13 illustrates a bottom portion of the sealed vessel according to another embodiment of the present invention. The body portion 21' of the sealed vessel is made of cylindrical metal, one of the open end thereof is made by fixing the disk-like cover 26 to the body portion 21' to be bottom of the sealed vessel and the shape of the annular groove of the cover is as same as that of the cover 22 of the afore-mentioned embodiment.

EXAMPLE

Figure 9:
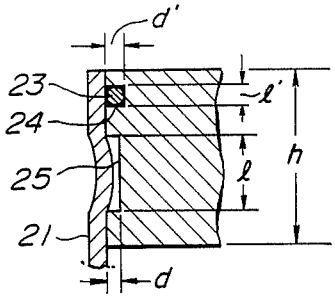
FIG. 9 is an enlarged view of the A portion of FIG. 4.

Now, the example of the liquid tank produced by the press-working process according to the present invention will be described with reference to FIGS. 8 and 9.

Respective portions of the liquid tank are shown by the characters and the sizes of the respective portions are shown in the Table 1.

TABLE 1

| RESPECTIVE PORTION | SIZE (mm) |
|---|---|
| H | 116 |
| h | 18 |
| t | 2.2 |
| D | 60.5 |

TABLE 1-continued

| RESPECTIVE PORTION | SIZE (mm) |
|---|---|
| l | 10 |
| l' | 3.7 |
| d | 3 |
| d' | 2.7 |

As the sealing member, an 0-ring made of nitrile rubber in 3.1 mm of thickness and in 45mm of outside circular diameter of ring is used. The cover and the body portion of the liquid tank is made of aluminum alloy(JIS 6061).

The sealing member made of the mixture of plastics and ceroplastics reveals its sealing effects not less than that of the sealing member made of nitrile rubber. In addition, as the material of the cover, JIS 3003 metal alloy, AC4C metal casting, etc., can be used, and as the material of the body portion, JIS 3003 metal alloy can be also used.

A liquid tank was produced by plastic deforming the body portion by means of the electromagnetic press-working to fix the outer peripheral surface of the cover to the inner peripheral surface of the body portion. In the electromagnetic press-working, the total energy KJ is represented by the equation $E=\frac{1}{2}CV^2$ wherein E represents the total energy, C represents a capacity of a condenser(micro F) and V represents a voltage(KV).

In the experiment, the electromagnetic press-working was done with the total energy of 9.6 KJ.

As the result, the liquid tank produced satisfied the following characteristic requirements with sufficiency.

(a) The degree of the sealing efficiency of the connected portion is 30 $Kg/cm^2$ and the water leak is not occurred.

(b) At the pressure of 90 $Kg/cm^2$, breakage of the tank is not occurred.

(c) After repeatedly pressing of 0 to 45 $kg/cm^2$ at 30,000 times, the liquid tank does not show any abnormality in its efficiencies.

In the embodiments, the present invention is explained mainly with respect to an liquid tank. However, the present invention is not restricted to it but is widely applied to a sealed vessel such as a gas bomb, a drinking can, a fire extinguisher or the like.

What is claimed is:

1. A sealed vessel comprising a cylindrical body portion having an open end, and a cover fitting in the open end of the body portion, the cover having at least on annular groove around an outer peripheral surface thereof, the sealed vessel being produced by pressing against an outside surface of the open end of the body portion so that an inside surface of the open end of the body portion is pressed against the outer peripheral surface of the cover to air-tightly fix the cover to the open end of the body portion.

2. A sealed vessel according to claim 1, wherein a part of the body portion is deformed to engage with one of the annular grooves.

3. A sealed vessel according to claim 2, wherein a sealing member is placed or embedded in at least one of the annular grooves around the outer peripheral surface of the cover.

4. A sealed vessel according to claim 3, wherein both the body portion and the cover are made of metal.

5. A sealed vessel according to claim 4, wherein the sealed vessel is a liquid tank provided in a cooling medium circular system, the liquid tank having an inlet portion, a processing member, and an outer portion, whereby the cooling medium is introduced into the inlet portion, processed with the processing member, and then discharged through the outlet portion.

6. A sealed vessel according to claim 5, wherein the sealing member is made of material selected from the group consisting of rubber and plastic.

7. A sealed vessel according to claim 5 wherein the processing member comprises a filtering member and a dehumidifying member.

8. A sealed vessel according to claim 3, wherein the body portion is made of metal and the cover is made of plastic.

9. A sealed vessel according to claim 8, wherein the sealing member is made of ceroplastic.

10. A sealed vessel according to claim 8, wherein the sealing member is made of a mixture of plastic and ceroplastic.

11. A sealed vessel according to claim 3, wherein the body portion is made of metal and the cover is made of plastic.

12. A sealed vessel according to claim 11, wherein the sealing member is made of a material selected from the group consisting of rubber and plastic.

13. A sealed vessel according to claim 2, wherein both the body portion and the cover are made of metal.

14. A sealed vessel according to claim 13, wherein the sealed vessel is a liquid tank provided in a cooling medium circular system, the liquid tank having an inlet portion, a processing member, and an outlet portion, whereby the cooling medium is introduced into the inlet portion, processed with the processing member, and then discharged through the outlet portion.

15. A sealed vessel according to claim 14, wherein the sealing member is made of a material selected from the group consisting of rubber and plastic.

16. A sealed vessel according to claim 14, wherein the sealing member is made of ceroplastic.

17. A sealed vessel according to claim 14, wherein the sealing member is made of a mixture of plastic and ceroplastic.

18. A sealed vessel according to claim 14, wherein the processing member comprises a filtering member and a dehumidifying member.

19. A sealed vessel according to claim 13, wherein the sealed vessel is a liquid tank provided in a cooling medium circular system, the liquid tank having an inlet portion, a processing member, and an outlet portion, whereby the cooling medium is introduced into the inlet portion, processed with the processing member, and then discharged through the outlet portion.

20. A sealed vessel according to claim 19, wherein the sealing member is made of a material selected from the group consisting of rubber and plastic.

21. A sealed vessel according to claim 19, wherein the sealing member is made of ceroplastic.

22. A sealed vessel according to claim 19, wherein the sealing member is made of a mixture of plastic and ceroplastic.

23. A sealed vessel according to claim 19, wherein the processing member comprises a filtering member and a dehumidifying member.

24. A sealed vessel according to claim 1, wherein both the body portion and the cover are made of metal.

25. A sealed vessel according to claim 24, wherein the sealed vessel is a liquid tank provided in a cooling medium circular system, the liquid tank having an inlet portion, a processing member, and an outlet portion, whereby the cooling medium is introduced into the inlet portion, processed with the processing member, and then discharged through the outlet portion.

26. A sealed vessel according to claim 25, wherein the sealing member is made of a material selected from the group consisting of rubber and plastic.

27. A sealed vessel according to claim 25, wherein the sealing member is made of ceroplastic.

28. A sealed vessel according to claim 25, wherein the sealing member is made of a mixture of plastic and ceroplastic.

29. A sealed vessel according to claim 25, wherein the processing member comprises a filtering member and a dehumidifying member.

30. A process for producing a sealed vessel comprising the steps of:

(a) inserting an outer peripheral surface of a cover, having an annular groove formed therein, into the open end of a body portion having an inner peripheral surface; and (b) applying an external force to an outside surface of the body portion so that the body portion is deformed to engage with the annular groove to airtightly fix the cover to the open end of the body portion.

31. A process for producing a sealed vessel according to claim 30, wherein the external force is an electromagnetic force.

32. A process for producing a sealed vessel according to claim 30, wherein the external force is a mechanical force.

* * * * *

UNITED STATES PATENT AND TRADEMARK OFFICE

CERTIFICATE OF CORRECTION

PATENT NO. : 4,934,552

DATED : June 19, 1990

INVENTOR(S) : Shigeyuki Koide, et al.

It is certified that error appears in the above-identified patent and that said Letters Patent is hereby corrected as shown below:

On the title page, after "[73] Assignee: Showa Denko Kabushiki Kaisha, Tokyo, Japan", please insert --Nippon Bulge Industries Ltd., Minamiashigara, Japan--

Signed and Sealed this

Twenty-fourth Day of September, 1991

*Attest:*

HARRY F. MANBECK, JR.

*Attesting Officer*

*Commissioner of Patents and Trademarks*